US007352792B2

(12) United States Patent
Smith

(10) Patent No.: US 7,352,792 B2
(45) Date of Patent: Apr. 1, 2008

(54) ENHANCED JOINTS FOR PINS AND ELECTRODES WITH ASYMMETRIC PROPERTIES

(75) Inventor: Robert E. Smith, Strongsville, OH (US)

(73) Assignee: Graftech International Holdings Inc., Parma, OH (US)

( * ) Notice: Subject to any disclaimer, the term of this patent is extended or adjusted under 35 U.S.C. 154(b) by 12 days.

(21) Appl. No.: 11/257,488

(22) Filed: Oct. 24, 2005

(65) Prior Publication Data

US 2007/0110119 A1 May 17, 2007

(51) Int. Cl.
*H05B 7/14* (2006.01)

(52) U.S. Cl. ..... 373/92; 373/91

(58) Field of Classification Search ..... 373/92, 373/91, 88, 93; 264/29.5; 403/320, 296, 403/DIG. 15, 32, 298, 299, 267, 333, 343; 439/429; 313/354, 357, 355, 332
See application file for complete search history.

(56) References Cited

U.S. PATENT DOCUMENTS

| | | | | |
|---|---|---|---|---|
| 2,527,294 A | | 1/1950 | Bailey | 313/332 |
| 2,957,716 A | | 1/1960 | Kaufmann et al. | 373/92 |
| 4,167,643 A | * | 9/1979 | Charnock | 373/91 |
| 4,290,709 A | | 9/1981 | Seldin et al. | 403/296 |
| 4,495,624 A | | 1/1985 | Reimpell et al. | 373/92 |
| 4,629,280 A | | 12/1986 | Semmier et al. | 373/92 |
| 5,015,518 A | * | 5/1991 | Sasaki et al. | 428/192 |
| 5,870,424 A | | 2/1999 | Todoriki et al. | 373/92 |

OTHER PUBLICATIONS

Joo and Lewallen, "Unitrode Joints for Arc Furnace Electrodes," 3rd Arc Furnace Meeting, 1981.
Moncrief and Salomon, "Electrode Properties/Specification—Their Real Value", 8th Polish Electrode Symposium, 1984 (abstract only).
Treugut and LeFrank, "Profiling and Loading Capacity of the Nipple-Case-Union Graphite Electrodes; Theoretical Considerations and Application Technological Study in an Electric Steel Furnace," Fachber.Huttenprax.Metall., 19:42-47 (No. 1, 1981) (abstract only).
International Electrotechnical Commission (IEC), International Standard, Third Edition, May 1997.
Japan Standards Association (JSA), Japanese Industrial Standard JIS R 7201: 1997, Cylindrical Machined Graphite Electrodes (1998).

* cited by examiner

*Primary Examiner*—Quang Van
(74) *Attorney, Agent, or Firm*—Waddey & Patterson, PC; James R. Cartiglia

(57) ABSTRACT

A joint for connecting two carbon members, with at least one carbon member having an asymmetrical coefficient of thermal expansion. The carbon member having the asymmetrical coefficient of thermal expansion also has either a male tang or a female socket with an elliptical cross section selectively oriented to the asymmetrical coefficient of thermal expansion.

6 Claims, 5 Drawing Sheets

ENHANCED JOINTS FOR PINS AND ELECTRODES WITH ASYMMETRIC PROPERTIES

BACKGROUND OF THE INVENTION

1. Field of the Invention

The present invention relates generally to an enhanced joint for connecting carbon members, such as graphite electrodes and graphite pins, with at least one carbon member having asymmetrical properties. More particularly, the invention addresses enhanced joints for graphite pins and electrodes with at least one having a cross section with an asymmetrical coefficient of thermal expansion (CTE).

2. Description of Related Art

Carbon electrodes are used in electrothermal furnaces to melt metals and other ingredients used to form metal alloys. (As used herein, the term carbon electrodes includes graphite electrodes.) Generally, the electrodes used in steel furnaces each consist of electrode columns, that is, a series of individual electrodes joined to form a single column. In this way, as electrodes are depleted during the thermal process, replacement electrodes can be joined to the column to maintain the length of the column extending into the furnace. These electrodes are joined into columns via a connecting pin that functions to join the ends of adjoining electrodes. Conventionally, electrodes are joined into columns via a pin (sometimes referred to as a nipple) that functions to join the ends of adjoining electrodes. Typically, the pin takes the form of opposed male threaded sections, with at least one end of each of the electrodes comprising female threaded sections capable of mating with a male threaded section of the pin. Thus, when each of the opposing male threaded sections of a pin are threaded into female threaded sections in the ends of two electrodes, those electrodes become joined into an electrode column. Commonly, the joined ends of the adjoining electrodes, and the pin therebetween, are referred to in the art as a joint.

Alternatively, the electrodes can be formed with a male threaded protrusion or tang machined into one end and a female threaded socket machined into the other end, such that the electrodes can be joined by threading the male tang of one electrode into the female socket of a second electrode, and thus form an electrode column. The joined ends of two adjoining electrodes in such an embodiment is referred to in the art as a male-female joint.

Carbon electrodes and pins may be fabricated by combining calcined petroleum coke and coal-tar pitch binder into a stock blend. In this multi-step process, the calcined petroleum coke is first crushed, sized and milled into a finely defined powder. Generally, particles up to about 25 millimeters (mm) in average diameter are employed in the blend. The particulate fraction preferable includes coke powder filler having a small particle size. Other additives that may be incorporated into the small particle size filler include iron oxides to inhibit puffing (caused by release of sulfur from its bond with carbon inside the coke particles), coke powder and oils or other lubricants to facilitate extrusion of the blend.

The stock blend is heated to the softening temperature of the pitch and is form pressed to create a "green" stock body such as an electrode or pin. For green electrode production, a continuously operating extruding press may be use to form a cylindrical rod known as a "green" electrode. For pin production, the green pin body is formed by die extrusion or by molding in a forming mold to form a "green pinstock".

The green stock body is heated in a furnace to carbonize the pitch so as to give the body permanency of form and higher mechanical strength. Depending upon the size of the electrodes or pins and upon the specific manufacturer's process, this "baking" step requires the green electrodes or pinstock to be heat treated at a temperature of between about 700° C. and about 1100° C. To avoid oxidation, the green stock body is baked in the relative absence of air. The temperature of the body is raised at a constant rate to the final baking temperature. For electrode or pin production, the green stock body is maintained at the final baking temperature for between 1 week and 2 weeks, depending upon the size of the electrode.

After cooling and cleaning, the baked electrode or pin may be impregnated one or more times with coal tar or petroleum pitch, or other types of pitches known in the industry, to deposit additional pitch coke in any open pores of the electrode or the pin. Each impregnation is then followed by an additional baking step, including cooling and cleaning. The time and temperature for each re-baking step may vary, depending upon the particular manufacturer's process. Additives may be incorporated into the pitch to improve specific properties of the graphite electrode or pin. Each such densification step (i.e. each additional impregnation and re-baking cycle) generally increases the density of the stock material and provides for a higher mechanical strength. Typically, forming each electrode or pin includes at least one densification step. Many such articles require several separate densification steps before the desired density is achieved.

After densification, the electrode or pin, referred to at this stage as a carbonized body, is then graphitized. Graphitization is by heat treatment at a final temperature of between about 1500° C. to about 3400° C. for a time sufficient to cause the carbon atoms in the calcined coke and pitch coke binder to transform from a poorly ordered state into the crystalline structure of graphite. At these high temperatures, elements other than carbon are volatilized and escape as vapors. Carbonized bodies formed in the above manner have generally symmetric cross sectional CTE's.

Carbonized bodies can alternatively be formed by the resistive heating of a stock blend of coke, pitch and, optionally, carbon fibers, or other suitable mixture of carbon filler, reinforcement and matrix materials. Preferably, the stock blend includes raw coke, high melting point pitch and carbon fibers derived from pitch. Optionally, the stock blend may also include calcinated coke, graphite, carbon fibers, coal tar pitch, petroleum pitch, or coking catalysts such as sulfur. As desired, additives may be added to improve the processing characteristics of the blend or to improve the physical characteristics of the graphite electrode or pin. Such additives may be added during mixing or after forming the stock blend. During the process, resistance heating is accompanied by the application of mechanical pressure (this combination is referred to as "hot pressing") to increase the density and carbonization of the blend. The resulting carbonized body or "preform" is preferably subjected to graphitization after hot-pressing by heating the preform to a final temperature of between about 1500° C. to about 3400° C. to remove remaining non-carbon components and form a material which is almost exclusively graphite. Optionally, after hot-pressing, the preform electrode or pin may be subjected to one or more densification steps employing a carbonizable pitch to further increase the density of the preform prior to the graphitization step. Forming the carbonized bodies through the hot-pressing step results in the carbonized bodies having asymmetrical properties. In this method of preparation, the cross sectional CTE of the resulting carbon body is asymmetric.

After graphitization is completed, the electrode or pin can be cut to size and then machined or otherwise formed into its final configuration. Given its nature, graphite permits machining to a high degree of tolerance, thus permitting a strong connection between pin and electrode in a joint system or between electrode and electrode in a male-female joint system. (As used herein, the term joint includes both a joint system between a pin and an electrode and a male-female joint system between two electrodes.) Machining the graphitized electrode removes only a small fraction of the overall mass of the electrode, while machining the graphitized pin typically removes up to about 40% or more of the mass of the pin. Thus, the material yield is only about 60% for manufacture of connecting pins.

Carbon members having generally symmetric CTE's across their cross sectional dimensions have joints with substantially circular cross sections. As previously described, these joints can be composed of male tangs from graphite pins or graphite electrodes and female sockets from graphite electrodes. Correspondingly, the male tangs and female sockets composing these joints also have substantially circular cross sections. Since the cross sections of the male tangs and the female sockets have generally symmetric CTE's, the stresses induced in the joint by thermal expansion are fairly uniform across the joint interface, the interface between the male tang and female socket.

The stresses caused by thermal expansion are fairly uniform because the thermal expansion across the cross sections of both carbon members occurs at similar rates and in similar directions. As a result of the male tang and female socket both having substantially circular cross sections, the gap around the joint interface is uniform. Since the cross sectional thermal expansion of the carbon members is generally symmetric, this uniform gap allows the male tang and female socket to expand or reduce during thermal cycles without causing disproportionate stresses around the joint interface.

During exposure to heat, the gap around the joint interface reduces with only slight, if any, variation since the thermal expansion of the two carbon members is symmetric. Because of the uniform gap around the joint interface and the carbon member's generally symmetric cross sectional CTE's, the structural integrity of the joint is maintained as the carbon members are exposed to elevated temperatures as seen in an electrothermal furnace.

Joining a carbon member having an asymmetrical CTE across its cross sectional dimension and a carbon member having a generally symmetric CTE across its cross sectional dimension can pose some challenges. As the carbon members are exposed to heat, the differences in CTE's would cause dissimilar rates of thermal expansion across the cross sections of the carbon members. If the cross sections of the male tang and female socket of the carbon members to be joined were both substantially circular, the differing cross sectional CTE's would expand at different rates and induce stress in the joint.

These stresses may arise because the substantially circular cross sections do not allow much variation of the gap around the joint interface to accommodate the differing rates of expansion. If a uniform gap was left around the joint interface, some areas of the gap around the joint interface may be reduced by the differing rates of thermal expansion while in other areas the gap around the joint interface may not be reduced as much. This varying reduction or expansion of gaps around the joint interface occurs because at least one of the carbon members has an asymmetrical CTE across its cross sectional dimension and therefore one dimension of the cross section of the carbon member will expand more than the other dimension.

With no variable gap around the joint interface to compensate for the increased expansion in that one dimension, destructive stresses in that dimension could possibly arise. These destructive stresses could result in a weakening or possible failure of the joint.

BRIEF SUMMARY OF THE INVENTION

The present invention provides for a carbon member having a male tang formed in at least one end and an asymmetrical CTE across its cross sectional dimension, with at least one male tang having an elliptical cross section selectively oriented with respect to the asymmetrical CTE.

A second embodiment of the present invention includes a joint between a carbon structure with an asymmetrical CTE and a carbon structure with a more symmetric CTE. The mating end, either a threaded male tang or threaded female socket, of one carbon structure will be shaped with an elliptical cross section and the corresponding mating end of the other carbon structure will be shaped in a generally circular cross section.

A third embodiment of the present invention includes a method of forming enhanced joints for carbon members. A first carbon member is fabricated having at least one threaded male tang and a second carbon member is fabricated having at least one threaded female socket. At least one of the carbon members has an asymmetrical CTE in the cross sectional dimension and a mating end, a male tang or a female socket, with an eccentric cross section selectively oriented with respect to the asymmetrical CTE. The other carbon member has a corresponding mating end with a generally circular cross section. The two carbon members can then be rotationally engaged creating a joint. The gap in the joint, caused by the difference in cross sections, may be reduced by the dissimilar rates of thermal expansion in the carbon members during the application of heat.

Accordingly, it is an objective of the present invention to provide a carbon member, having an asymmetrical CTE in the cross sectional dimension, suitable for use in an electrothermal furnace.

It is an additional objective of the invention to provide a carbon member, having an asymmetrical CTE in the cross sectional dimension, with a threaded male tang or threaded female socket having an elliptical cross section selectively oriented with respect to the asymmetrical CTE.

It is another objective of the invention to provide a joint between two carbon members with at least one having an asymmetrical CTE in the cross sectional dimension and a threaded male tang or threaded female socket with an eccentric cross section selectively oriented to the asymmetrical CTE. The other carbon member having the corresponding mating end with a generally circular cross section.

Finally, it is an objective of the present invention to provide a method of forming joints for carbon members with at least one carbon member having an asymmetrical CTE. The joint between the two carbon members being suitable for use in connecting graphite electrodes to graphite pins or graphite electrodes to graphite electrodes. The joint also being suitable to withstand the operating conditions commonly encountered in an electrothermal furnace.

DETAILED DESCRIPTION OF THE INVENTION

Figure 1:
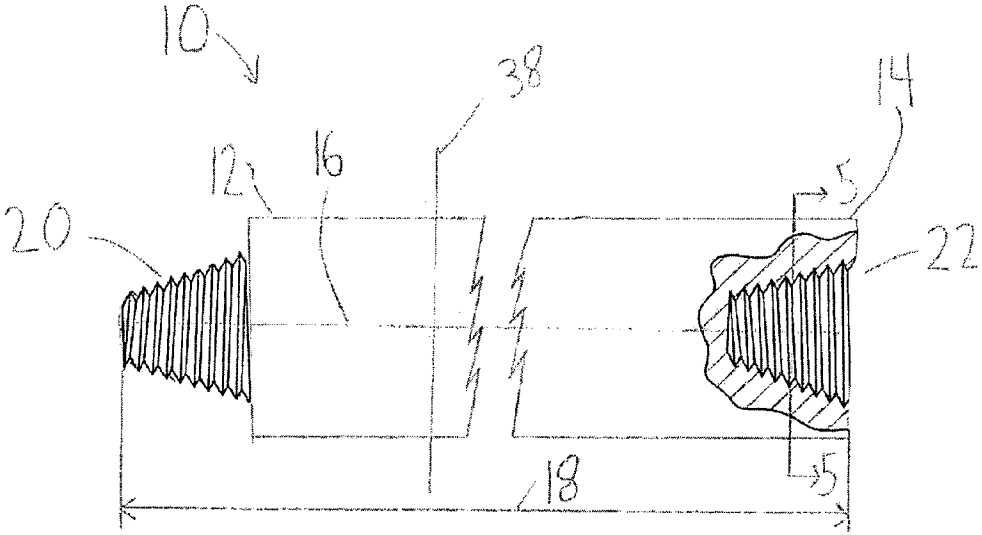
FIG. 1 is a side view of a graphite electrode with a threaded male tang on one end and a cut out showing a threaded female socket on the other end.

Referring now to the drawings, FIG. 1 shows a graphite electrode 10 suitable for use in an electrothermal furnace. Graphite electrode 10 has two end portions 12 and 14 and a longitudinal axis 16 extending between the two end portions 12 and 14. Longitudinal axis 16 is parallel to the length 18 of graphite electrode 10, length 18 being measured between end portions 12 and 14.

End portions 12 and 14 of graphite electrode 10 may have a male tang 20, a female socket 22, or neither. Male tang 20 is a protrusion extending from graphite electrode 10 along longitudinal axis 16. Female socket 22 can also be described as a bore recessed in graphite electrode 10 extending from one end portion 12 or 14 towards the other end portion 12 or 14. In the preferred embodiment, both male tang 20 and female socket 22 will at least be partially threaded.

Figure 3:
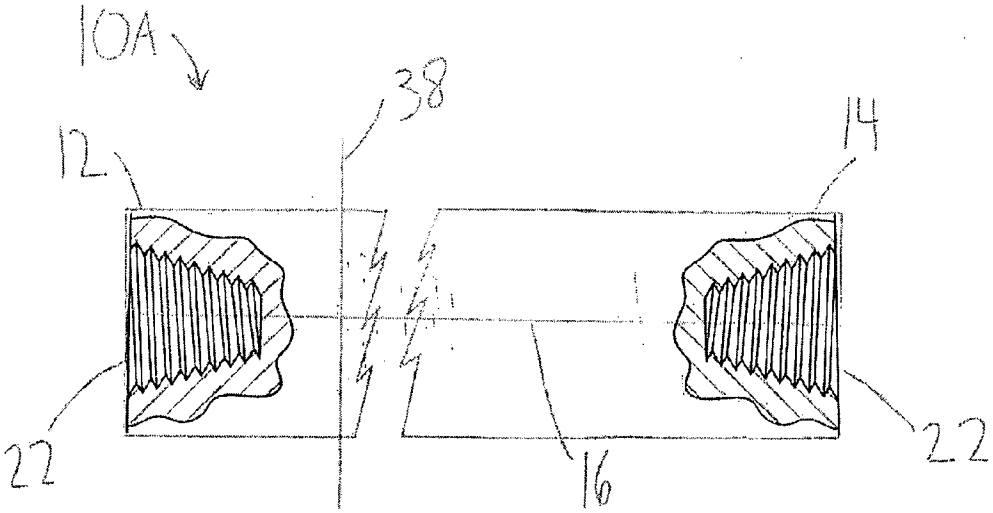
FIG. 3 is a side view of a graphite electrode with cut outs showing threaded female sockets on either end.

Graphite electrode 10 can have threaded female socket 22 in one end portion 12 or 14 and threaded male tang 20 in the other end portion 12 or 14. As shown in FIG. 3, an alternate graphite electrode 10A can also have two threaded female sockets 22 in both end portions 12 and 14. Graphite electrode 10 has a cross section in a plane 38 normal to longitudinal axis 16. Graphite electrode 10 may have an asymmetrical or symmetrical CTE across its cross section. Graphite electrode 10 may be more generally referred to as a carbon member or alternatively a carbon structure.

Figure 2:
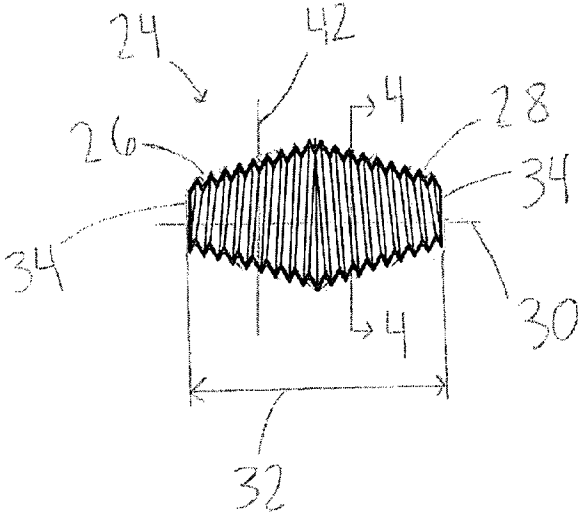
FIG. 2 is a side view of a graphite pin with opposed threaded male tangs.

FIG. 2 shows a graphite pin 24 suitable for use in an electrothermal furnace. Graphite pin 24 has two end portions 26 and 28 and a longitudinal axis 30 extending between end portions 26 and 28. Longitudinal axis 30 is parallel to the length 32 of graphite pin 24, length 32 being measured between two end portions 26 and 28. Preferably graphite pin 24 has opposed threaded male tangs 34 on end portions 26 and 28. Male tang 34 is a protrusion extending from graphite pin 24 along longitudinal axis 30.

Graphite pin 24 has a cross section in a plane 42 normal to longitudinal axis 30. Graphite pin 24 may have an asymmetrical or symmetrical CTE across its cross section. Graphite pin 24 may also be more generally referred to as a carbon member or alternatively a carbon structure.

Threaded male tang 20 of graphite electrode 10 or threaded male tang 34 of graphite pin 24 and threaded female socket 22 of graphite electrode 10 can be rotationally engaged, similar to a screwing motion, to securely couple carbon members together. One graphite electrode 10 with one male tang 20 and one female socket 22 can be used with another graphite electrode 10 with a similar construction to form electrode columns without the aid of graphite pin 24. Also, an electrode column can be formed using multiple graphite electrodes 10A (see FIG. 3) with two female sockets 22 each and graphite pins 24 connecting the graphite electrodes 10A.

Graphite pin 24 is at least partially formed through a hot-pressing process, a process involving resistive heating with the application of mechanical pressure occurring for at least a portion of the resistive heating cycle, may have an asymmetrical CTE across its cross section. Graphite pin 24 may also be formed having an asymmetrical CTE by other processes and is not limited to only the process described herein.

Graphite electrode 10 or 10A may also be formed through a hot-pressing process and would have similar CTE properties to that of graphite pin 24 described above. That is, graphite electrode 10 or 10A formed through a hot-pressing process may have a more asymmetrical CTE across its cross section than in a direction generally parallel to longitudinal axis 16.

Figure 4A:
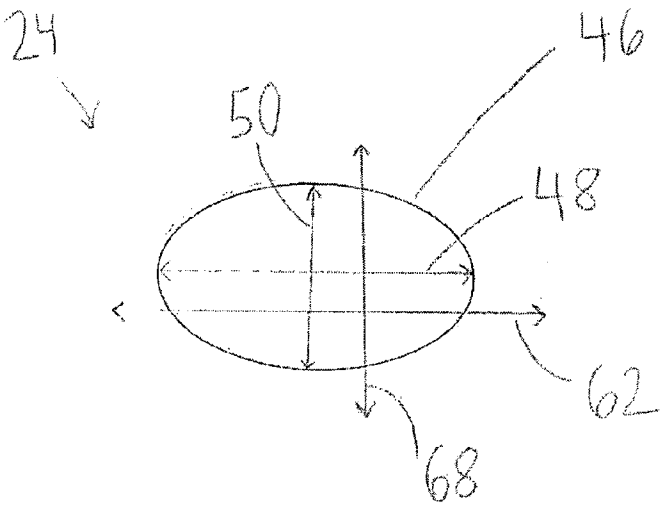
FIG. 4A is an exaggerated cross section of FIG. 2 taken along line 4.
Figure 4B:
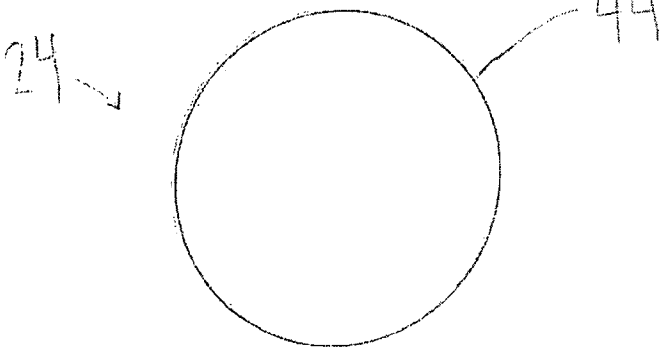
FIG. 4B is an alternative cross section of FIG. 2 taken along line 4.

Graphite pins 24 may have male tangs 34 with substantially circular cross sections 44 as shown in FIG. 4B. A substantially circular cross section 44 encompasses cross sections intended to be circular but which are not due to machining inaccuracies and other process deficiencies and tolerances.

Graphite pins 24 may also have male tangs 34 with elliptical cross sections 46 as shown in FIG. 4A. These elliptical cross sections 46 have a long axis 48 and a short axis 50. Long axis 48 spans the greatest distance between any two points contained on elliptic cross section 46. Short axis 50 is transverse to long axis 48. Long axis 48 may also be referred to as the major axis 48, and short axis 50 may also be referred to as the minor axis 50. The elliptical cross section 46 of FIG. 4A may also be described as being an eccentric cross section 46 or as an elongated circular cross section 46, and need not be truly elliptical in the geometric sense. The cross section in FIG. 4A is exaggerated and the actual eccentricity may only be thousandths of an inch as compared with a substantially circular cross section 44.

In one embodiment of the present invention, long axis 48 of elliptical cross section 46 of male tang 34 is selectively oriented with respect to the asymmetrical CTE of graphite pin 24. In another embodiment, short axis 50 of elliptical cross section 46 of male tang 22 is selectively oriented with respect to the asymmetrical CTE. In effect, the orientation of elliptical cross section 46 is specifically chosen in relation to the properties of the asymmetrical CTE of the cross section of graphite pin 24.

Figure 5A:
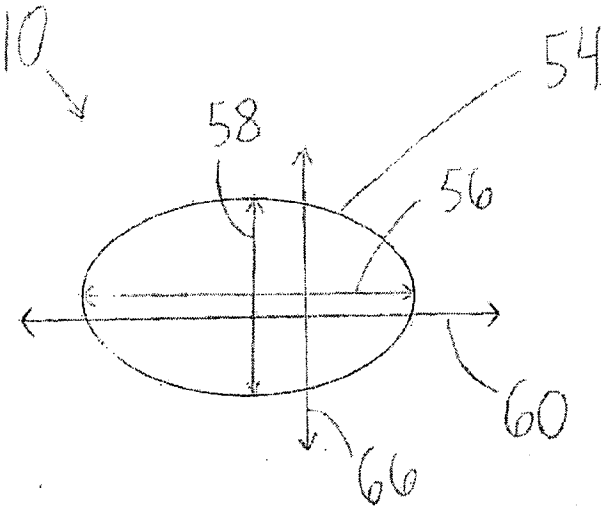
FIG. 5A is an exaggerated cross section of FIG. 1 taken along line 5.
Figure 5B:
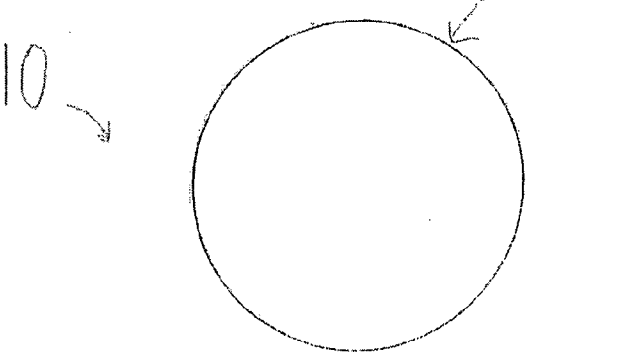
FIG. 5B is an alternative cross section of FIG. 1 taken along line 5.

Similar to graphite pins 24, graphite electrodes 10 or 10A may also have male tangs 20 and/or female sockets 22 with substantially circular cross sections 52 as shown in FIG. 5B. A substantially circular cross section 52 encompasses cross sections intended to be circular but which are not due to machining inaccuracies and other process deficiencies and tolerances.

Graphite electrodes 10 or 10A may also have male tangs 20 and/or female sockets 22 with elliptical cross sections 54 as shown in FIG. 5A. These elliptical cross sections 54 have a long axis 56 and a short axis 58. Long axis 56 spans the greatest distance between any two points contained on elliptic cross section 54. Short axis 58 is transverse to long axis 56. Long axis 56 may also be referred to as the major axis 56, and the short axis 58 may also be referred to as the minor axis 58. Elliptical cross section 54 of FIG. 5A may also be described as being an eccentric cross section 54 or as an elongated circular cross section 54, and need not be truly elliptical in the geometric sense. The cross section in FIG. 5A is exaggerated and the actual eccentricity may only be thousandths of an inch as compared with a substantially circular cross section 52.

In one embodiment of the present invention, long axis 56 of elliptical cross section 54 of at least one of end portions 12 and/or 14 is selectively oriented with respect to the asymmetrical CTE of graphite electrode 10 or 10A. In another embodiment, short axis 58 of elliptical cross section 54 of at least one of end portions 12 and/or 14 is selectively oriented with respect to the asymmetrical CTE. In effect, the orientation of elliptical cross section 54 is specifically chosen in relation to the properties of the asymmetrical CTE of the cross section of graphite electrode 10 or 10A.

Again referring to FIG. 5A, female socket 22 having an elliptical cross section 54 with an asymmetrical CTE will preferably have short axis 58 generally parallel to the direction of the maximum CTE 66. The direction of the maximum CTE 66 is the direction across the cross section which will expand the most compared to any other directions on the same cross section. The direction of minimum CTE 60 is transverse to the direction of maximum CTE 66. Generally parallel means as close to parallel as process tolerances allow when shaping the cross section.

Now referring to FIG. 4A, male tang 34 having elliptical cross section 46 with an asymmetrical CTE will preferably have long axis 48 generally parallel to the direction of the minimum CTE 62. The direction of minimum CTE 62 is the direction across the cross section which will expand the least compared to any other directions on the same cross section. The direction of maximum CTE 68 is transverse to the direction of minimum CTE 62.

Figure 6:
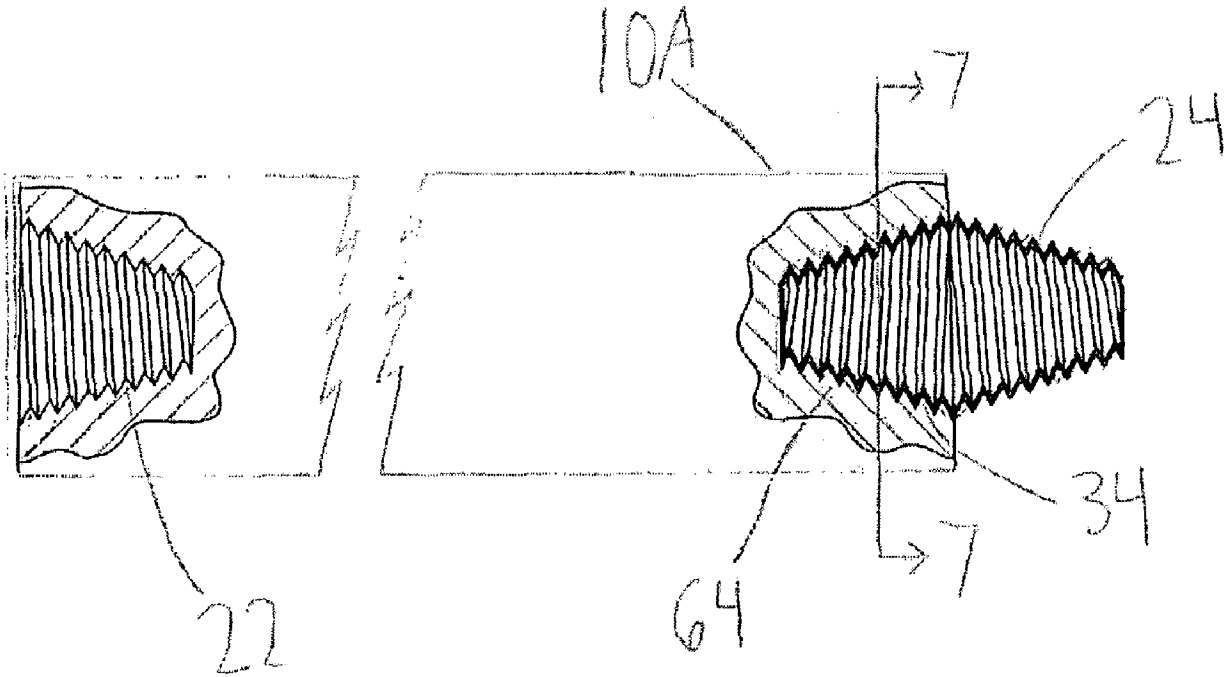
FIG. 6 is a side view of a joint formed between the threaded female socket of a graphite electrode and a threaded male tang of a graphite pin.

Referring now to FIG. 6, the connections between graphite electrodes 10A and graphite pins 24 or between one graphite electrode 10 and another graphite electrode 10 are called joints 64. More specifically, joints 64 are formed by rotationally engaging male tangs 20 of graphite electrodes 10 or male tangs 34 of graphite pins 24 that are at least partially threaded to female sockets 22 of graphite electrodes 10 or 10A that are at least partially threaded.

The scope of the present invention embodies a joint 64 formed between a first carbon member and a second carbon member with at least one of the carbon members having an asymmetrical CTE. As used hereinafter, the term carbon member includes graphite pins 24 and graphite electrodes 10 or 10A as a joint 64 can be formed between a graphite pin 24 and a graphite electrode 10A or between two graphite electrodes 10. For illustrative purposes only, joint 64 shown in FIG. 6 embodies the connection of graphite electrode 10A and graphite pin 24.

Figure 7A:
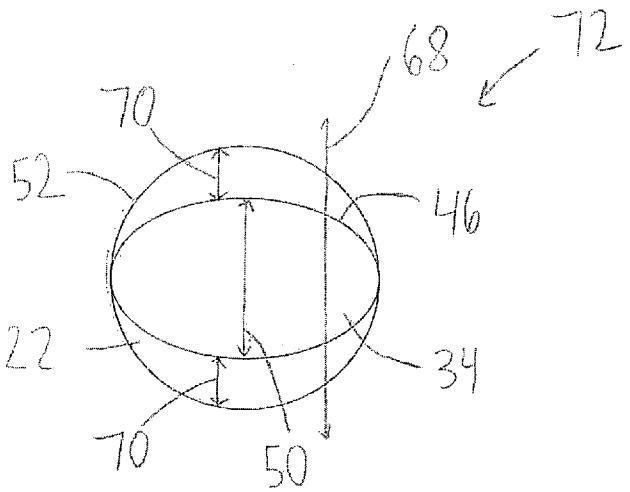
FIG. 7A is an exaggerated cross section of FIG. 6 taken along line 7.

In the preferred embodiment of joint 64, joint cross section 72 shown in FIG. 7A includes an elliptical cross section 46 of male tang 34 of graphite pin 24 and substantially circular cross section 52 of female socket 22 of graphite electrode 10A. Graphite pin 24 has an asymmetrical CTE across its cross section. Preferably, graphite electrode 10 has a more symmetrical CTE across its cross section than graphite pin 24. Gap 70 is left after joining graphite pin 24 and graphite electrode 10 and results from the difference in the cross sections of graphite pin 24 and graphite electrode 10A.

Gap 70 will decrease as joint 64 is subjected to an increase in temperature because short axis 50 of elliptical cross section 46 is generally parallel to the direction of the maximum CTE 68. Therefore, elliptical cross section 46 of graphite pin 24 will expand more along short axis 50 than it will along long axis 48 thereby reducing gap 70.

Gap 70 and therefore the cross section of graphite electrode 10A and the cross section of graphite pin 24 will be designed as to reduce to a desired size during an increase in temperature. Resulting gap 70 will be of an appropriate size to promote a secure joint 64 between graphite pin 24 and graphite electrode 10A at an elevated temperature as seen in an electrothermal furnace.

The size of gap 70 can be varied according to the individual properties of the particular graphite electrode 10A or graphite pin 24. This can be accomplished by measuring the CTE's of graphite electrode 10A and graphite pin 24 and shaping the cross sections accordingly. Preferably the cross section of female socket 22 of graphite electrode 10A will be substantially circular and the cross section of male tang 34 of graphite pin 24 will be elliptical. Shaping the cross sections can be accomplished through a machining process. Determining and shaping the appropriate size of gap 70 is not limited to the processes described herein.

Figure 7B:
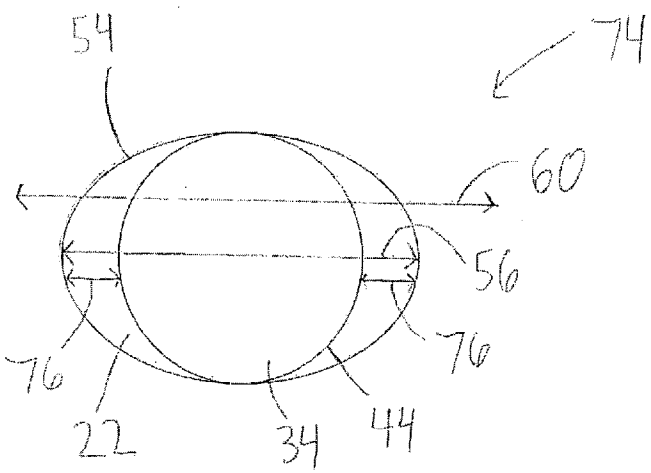
FIG. 7B is an alternative exaggerated cross section of FIG. 6 taken along line 7.

In another embodiment of the enhanced joint, the cross section of joint 74 shown in FIG. 7B includes an elliptical cross section 54 of female socket 22 of graphite electrode 10A and a substantially circular cross section 44 of male tang 34 of graphite pin 24. Graphite electrode 10A has an asymmetrical CTE across its cross section. Preferably, graphite pin 24 has a more symmetrical CTE across its cross section than graphite electrode 10.

Gap 76 is left after joining graphite pin 24 and graphite electrode 10A. Long axis 56 of elliptical cross section 54 of graphite electrode 10A is generally parallel to the direction of minimum CTE 66. As the joint 64 is subject to an increase in temperature, as seen in an electrothermal furnace, gap 76 is reduced. Gap 76 is reduced because the elliptical cross section 54 of graphite electrode 10 will expand more along long axis 56 than it will along short axis 58, thereby reducing gap 76. Gap 76 is reduced because pin 24 typically has a larger CTE in its cross-section than does electrode 10. The elliptical cross-section 54 of the socket of graphite electrode 10 will become more nearly circular since the short axis of the cross-section is oriented parallel to the high CTE direction of electrode 10.

The size of gap 76 can be varied to achieve the desired result, a secure joint 64. In this embodiment, preferably gap 76 will be sized by varying the eccentricity of the cross section of female socket 22 of graphite electrode 10A while maintaining a substantially circular cross section 44 for male tang 34 of graphite pin 24.

The scope of the present invention also envisions joint 64 formed between two graphite electrodes 10, each graphite electrode 10 having a male tang 20 and a female socket 22 and at least one of graphite electrodes 10 having an asymmetrical CTE across its cross section. In the preferred embodiment, first graphite electrode 10 has an asymmetrical CTE and male tang 20 and female electrode 22, each having elliptical cross sections 54. Preferably, second graphite electrode 10 has a more symmetrical CTE across its cross section and male tang 20 and female electrode 22 with substantially circular cross sections 52. The cross sections of graphite electrodes 10 will be sized so that during the application of heat a secure joint 64 will be formed.

In an alternative embodiment of the present invention, both carbon members could have asymmetrical CTE's across their cross sections. In this embodiment, both carbon members would have elliptical cross sections 54 and/or 46. The cross sections would have to be sized and shaped to allow the formation of a secure joint 64 during the carbon members exposure to heat as seen in an electrothermal furnace.

Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A carbon member, comprising:

(a) a carbon body having two end portions and a longitudinal axis extending therebetween, wherein the coefficient of thermal expansion of the carbon body is asymmetrical across its cross-sectional dimension; and (b) a male tang formed in at least one of the end portions of the carbon body, wherein the male tang is at least partially threaded and is formed so as to assume an elliptical cross section in a plane normal to the longitudinal axis of the carbon body, the elliptical cross section comprising a long axis and a short axis, and further wherein the long axis is selectively oriented with respect to the asymmetrical coefficient of thermal expansion of the carbon body.

2. The carbon member of claim 1, wherein one of the end portions of the carbon body has at least a partially threaded bore recessed therein with the bore extending from one end portion towards the other end portion, and further wherein the bore comprises an elliptical cross section defined in a plane orthogonal to the longitudinal axis with the elliptical cross section comprising a major axis and a minor axis.

3. The carbon member of claim 2, wherein the minor axis of the elliptical cross section of the bore is oriented generally parallel to a direction of a maximum coefficient of thermal expansion.

4. The carbon member of claim 1, wherein the long axis of the elliptical cross section of the male tang is oriented generally parallel to a direction of a minimum coefficient of thermal expansion.

5. The carbon member of claim 1, wherein the carbon member comprises a graphite pin, and wherein both end portions of the carbon body of the graphite pin comprise at least partially threaded male tangs so that the graphite pin can connect graphite electrodes for use in an electrothermal furnace.

6. The carbon member of claim 1, wherein the carbon member comprises a graphite electrode suitable for use in an electrothermal furnace.

* * * * *